United States Patent [19]

Winship et al.

[11] Patent Number: 5,040,622

[45] Date of Patent: Aug. 20, 1991

[54] VARIABLE DEPTH GROOVED DRILL STRING MEMBER

[75] Inventors: Thomas E. Winship; Edmond I. Bailey, both of Houston, Tex.

[73] Assignee: Shaw Industries Ltd., Rexdale, Canada

[21] Appl. No.: 524,167

[22] Filed: May 16, 1990

[51] Int. Cl.[5] ..... E21B 17/22

[52] U.S. Cl. ..... 175/323; 285/333

[58] Field of Search ..... 175/323; 285/333, 334, 285/286

[56] References Cited

U.S. PATENT DOCUMENTS

| | | | |
|---|---|---|---|
| 2,334,350 | 11/1943 | Neuhaus | 308/4 |
| 2,999,552 | 9/1961 | Fox | 175/323 |
| 3,125,173 | 3/1964 | Fox | 175/323 |
| 3,784,238 | 1/1974 | Chance, et al. | 285/286 |
| 4,460,202 | 7/1984 | Chance et al. | 285/333 |
| 4,811,800 | 3/1989 | Hill et al. | 125/323 |

OTHER PUBLICATIONS

Design of Machine Elements, Fifth Edition; Prentice-Hall Inc; 1978.

*Primary Examiner*—William P. Neuder

*Attorney, Agent, or Firm*—Dodge, Bush, Moseley & Riddle

[57] ABSTRACT

An intermediate weight member (10) having a variable cross-section or bending moment of inertia as a function of member length is disclosed. At one end of the member (10) a slip and elevator section (14) is provided. A partially grooved section (16) of a diameter greater than that of the slip and elevator section extends between the slip and elevator section (24) and the other end of the member (10). The partially grooved section (16) includes two variable depth grooved sections (18, 20) separated by an ungrooved section (22). The ungrooved section (22) includes hardbanding rings (26, 28). The spiral grooves (30A, 30B, 30C) of variable depth grooved section (18, 20) vary in depth as a function of member length such that the bending moment of inertia varies as a function of length from the slip and elevator section (14) to the lower end of the member (10). Such variation changes from a constant bending moment of inertia at the slip and elevator section (14) to a substantially greater bending moment of inertia at the ungrooved section (22) and thence to a lower bending moment of inertia of a reduced diameter section (24) at its other end.

20 Claims, 2 Drawing Sheets

10
11
12
14
16
18
20
22
24
26
28
D
d1
d2
P1
P2
L22
MOMENT OF INERTIA
MODULUS
LENGTH (INCHES)
0
50
100
150
200
250
300
350
CROSS SECTION MOMENT OF INERTIA
CROSS SECTION MODULUS
0
10
20
30
40
50
60
70
80
90

VARIABLE DEPTH GROOVED DRILL STRING MEMBER

BACKGROUND OF THE INVENTION

1. Field of the Invention

This invention relates in general to drill string members used in the rotary drilling art of the oil and gas industry. In particular the invention relates to an intermediate weight member adapted for placement between relatively lighter weight drill pipe and heavier weight drill collars.

2. Description of Prior art

Intermediate weight members have been used in the art of rotary drilling as a transition member between stiff drilling collars and standard drill pipe. Such intermediate weight members reduce fatigue in the stress-susceptible transition zone between drill pipe and drilling collars.

A prior art intermediate weight member sold by OMSCO Industries, the assignee of the invention described herein, includes a relatively heavy weight tubular member having upper and lower sections separated by a short center wear pad. The member has a constant inner diameter along its entire length. The upper and lower sections are of constant outer diameter. The wear pad has an outer diameter which is slightly less than about one-half inch larger than the outer diameter of the upper and lower sections. The outer diameter of the upper section is small enough to enable handling by standard slips and elevators of a drilling rig. The cross-section moment of inertia of the OMSCO intermediate weight member is significantly greater at the center wear pad from that at the upper and lower constant outer diameter sections. Accordingly, the OMSCO intermediate weight member, because of its construction, can be characterized by upper and lower relatively limber sections separated by a relatively stiff center section.

Another intermediate weight drill string member is described in U.S. pat. no. 4,460,202 to Chance et.al. The Chance drill string member includes an upper relatively short slip and elevator section and a lower grooved section which extends substantially the remaining length of the member. The grooved section is of an outer diameter which is larger than the outer diameter of the slip and elevator section, but has spiral grooves formed therein of a number and depth such that the bending moment of inertia along the entire length of the member is substantially constant. In other words, the cross-section moment of inertia anywhere along the spiral section is substantially equal to the cross-section moment of inertia in the slip and elevator area. As a consequence, the Chance member can be characterized as having a single bending pattern which is substantially constant from one end of the member to the other. In addition, the spiralled grooved section provides advantages, like other spiralled members, of reduced potential for differential sticking in the hole, aiding in the removal of drilling chips up the annulus between the drill string and the borehole, and possible forward thrusting effect during drilling.

3. Identification of objects of the invention

It is a primary object of the invention to provide certain advantages of the two prior art intermediate weight members described above with a unique mechanical structure.

It is another object of the invention to provide an intermediate weight member which includes not only a slip and elevator section and spiralled sections, but may also include a center wear pad section.

It is still another object of the invention to provide a drill string member of intermediate weight having a structure such that the cross-section moment of inertia of the member gradually changes a significant amount as a function of length along the member so as to reduce bending stresses inherent in regions where bending moments abruptly change.

SUMMARY OF THE INVENTION

The objects identified above as well as other advantages and features of the invention are incorporated in a drill string member which is an integral elongate tubular member having tool joints placed at each end for screwing to other drill string members above and below. Typically a plurality of the members constructed according to the invention are screwed end to end and form an intermediate weight assembly between drill pipe above and drill collars below. The member, of substantially constant inner diameter along its entire length, includes an upper slip and elevator section of a first outer diameter of a dimension substantially the same as the outer diameter of drill pipe for which it is adapted to connect.

In a preferred embodiment of the invention, the member includes a partially grooved section placed downwardly of the slip and elevator section. The outer diameter of the grooved section is greater than the outer diameter of the slip and elevator section. The grooved section includes first and second grooved sections separated by an ungrooved section.

The ungrooved section is a relatively short section which may include hardbanding rings. Such rings are typically welded on strips that include granulated tungsten carbide particles which inhibit wear. The first and second grooved sections include grooves which vary in depth as a function of the length of the respective section. The first grooved section between the slip and elevator section and the ungrooved section is characterized by spiral grooves which are cut deeply into the outer diameter of the section at its slip and elevator end. Such grooves are cut progressively less deeply as the length of the first section approaches the ungrooved section.

The second grooved section between the ungrooved section and the lower end of the member likewise has grooves cut into the outer diameter. The depth of such grooves also varies as a function of length. Such grooves are shallow at the ungrooved section end of the second grooved section and are progressively deeper as the length of the section approaches the lower end of the member.

As a result of the grooved sections which have groove depths which vary as a function of length of the member, the bending or cross-section moment of inertia of the member makes a relatively smooth transition from the slip and elevator section to the first grooved section as the length of the member increases from top to bottom. The term "bending moment" as used in the specification and claims shall be interpreted as the moment of inertia of a cross section where the deflection is calculated. With the depth of the grooves being cut progressively shallower, and then progressively deeper as a function of length along the member, the bending moment of inertia as a function of length increases approximately linearly from the slip and elevator section to the ungrooved section and thence decreases approximately linearly from the ungrooved section toward the lower end of the member. A relatively short reduced diameter section is provided at the lower end of the member. Tool joints are attached e.g., by welding to the top and bottom ends of the member.

The shape of the cross-section moment of inertia as a function of length along the member provides an intermediate heavy wall tool which is relatively more stiff at a short center section, yet is relatively more flexible at its ends. Such characteristics are advantageous in horizontal and directional drilling where the member is likely to be put under compression and a central, relatively more stiff and rugged region provides enhanced life and drilling performance. The spiralled sections of the first and second grooved sections not only provide the advantages of a smoothly varying cross-section moment of inertia of the member as a function of length, but also provide advantages of reducing possible differential sticking problems in the borehole. The novel structure also results in an intermediate weight drill string member of greater weight of the entire member as compared with prior art members. Such greater weight is advantageous in providing more weight on the drilling bit below. The novel structure also provides a greater wear surface toward the center of the member as compared with prior art members.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which.

DESCRIPTION OF THE INVENTION

Figure 1:
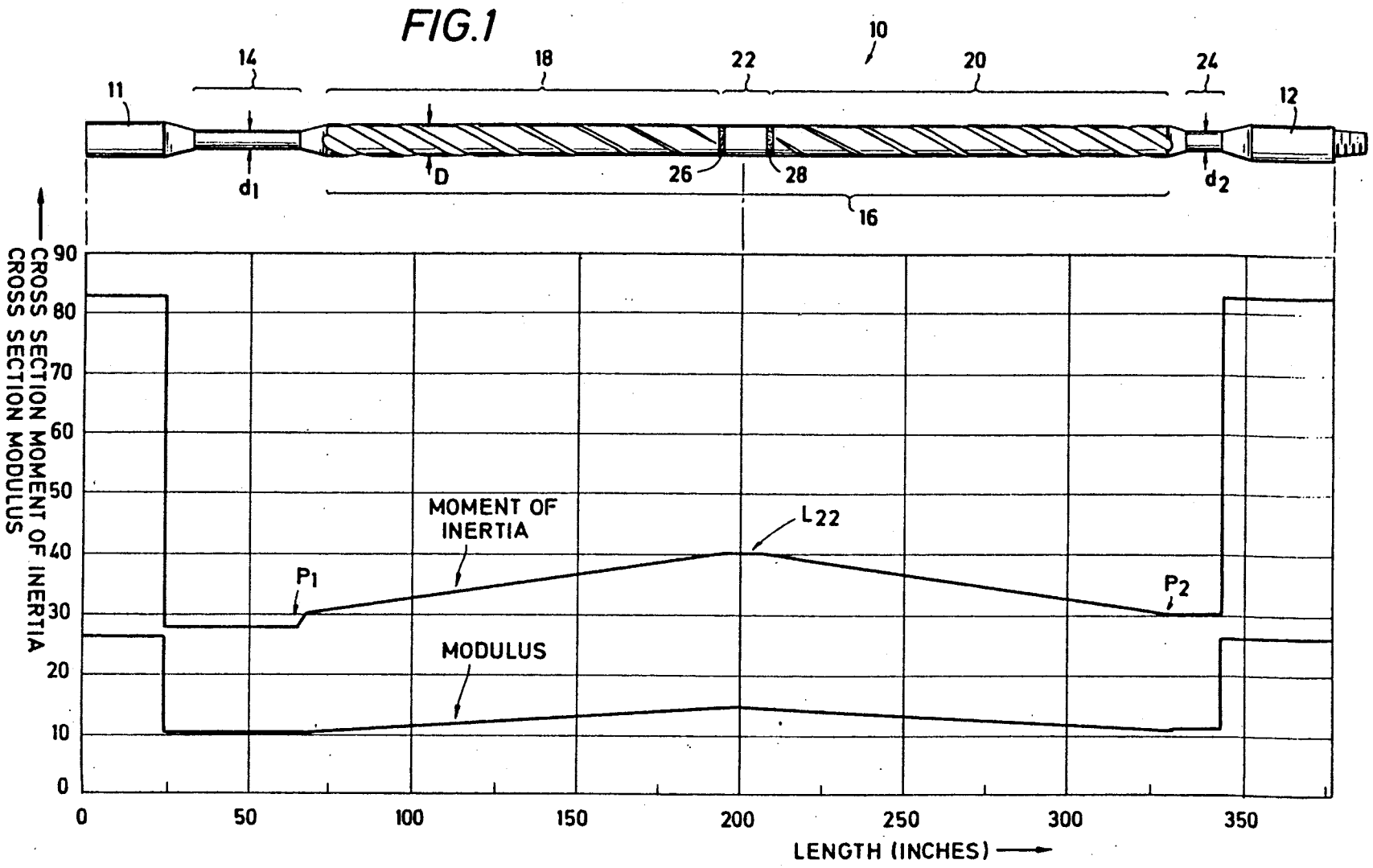
FIG. 1 is an illustration of the intermediate weight member of the invention with a graphical illustration of its bending moment of inertia as a function of length along the member.
Figure 2:
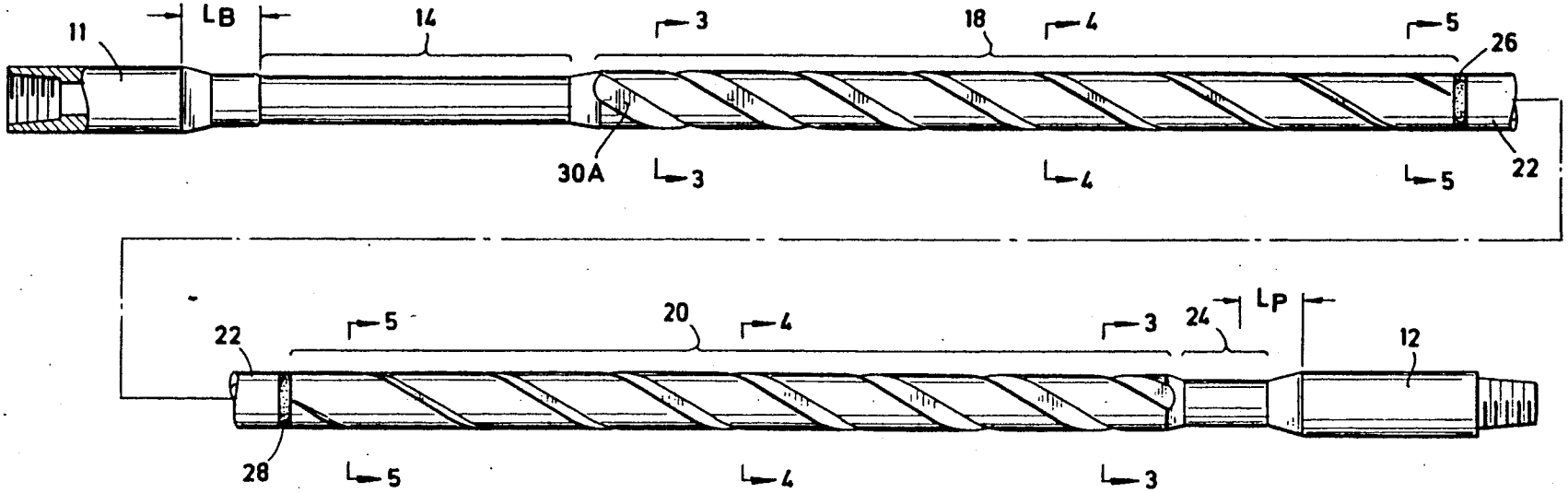
FIG. 2 is a more detailed illustration of the intermediate weight member of the invention showing tool joints provided at its upper and lower ends and grooved sections having grooves of varying depth provided below a slip and elevator section.

The preferred embodiment of the invention as defined by the claims below is illustrated in FIGS. 1 through 5 below. FIGS. 1 and 2 illustrate the elongated integral drill string member 10 having tool joints 11 and 12 provided (as by welding) to its upper and lower ends. The tool joint 11 is provided with box threads to releasably join member 10 with other members 10 or with a string of drill pipe above. The tool joint 12 is provided with pin threads to releasably join member 10 with other members 10 or with a bottom hole assembly including drill collars below.

The drill string member 10 has an internal bore of a substantially constant inside diameter along its entire length. It includes a slip and elevator section 14 having a diameter small enough to accommodate slip and elevator equipment of the drilling rig. Such diameter is typically matched to the outside diameter of drill pipe to which it is adapted to connect. The purpose of the drill string member 10 is to provide a thick or heavy wall drill pipe which can tolerate compression and tension forces between the thinner walled drill pipe above and the thicker walled drill collars below. A larger diameter for almost the entire remainder of drill string member 10 is advantageous.

Accordingly, the partially grooved section 16 is characterized by a diameter D which may be about five and one-half inches for a three inch inner diameter and a five inch outer diameter for slip and elevator section 14. These dimensions for other sizes of intermediate weight members are scaled depending on the drill pipe size, drill collars, and particular drilling application.

The partially grooved section 16 extends from the lower end of slip and elevator section 14 to a relatively short reduced diameter section 24 of a diameter $d_2$. For example, for five inch drill pipe diameter $d_2$ of reduced diameter section 24 is preferably five and one-eighth inches for an outside diameter D of about five and one-half inches of a partially grooved section 16. Diameter $d_2$ could of course be a smaller diameter. For example, it could match the diameter of the slip and elevator section. Diameter $d_1$ is the size typically used to describe the drill string member, e.g., five inch pipe. Alternatively, it need not be reduced in diameter from the diameter of partially grooved section 16, but providing a reduced diameter for section 24 increases the flexibility at the lower end of the drill string member 10, and as a consequence, reduces the bending stress of the drill string member 10.

The partially grooved section 16 includes first grooved section 18 disposed between slip and elevator section 14 and ungrooved section 22. A second grooved section 20 is provided between ungrooved section 22 and reduced diameter section 24 at the lower end of drill string member 10.

Figure 5:
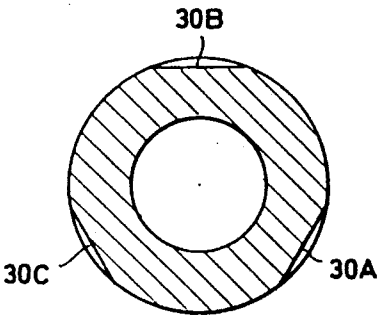
FIGS. 3, 4 and 5 are cross-section illustrations taken along section lines 3—3, 4—4, and 5—5 of FIG. 2, which show the depth of grooves varying as a function of length along the member.
Figure 4:
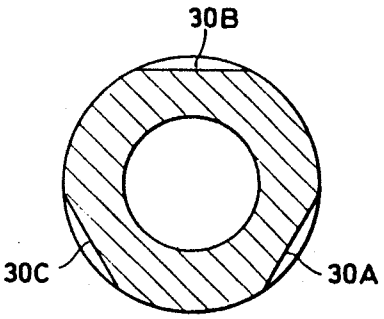
Figure 3:
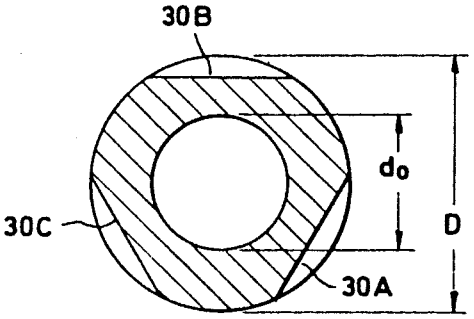

The first grooved section 18 preferably includes three right hand spiral grooves 30A, 30B, 30C, the depth of each of which varies progressively with increasing length from the lower end of slip and elevator section 14 to the upper end of ungrooved section 22. FIGS. 3, 4 and 5 taken at upper, middle and lower section lines 3—3, 4—4 and 5—5 of upper grooved section 18 illustrate that grooves 30A, 30B, and 30C become more and more shallow toward the ungrooved section 22 end, and yet are relatively deep at the upper end of grooved section 18. The depth of the grooves 30A, 30B, 30C at the slip and elevator section is such that the bending moment of inertia at the upper end of first grooved section 18 is approximately the same as that of the slip and elevator section 14.

To illustrate such feature, the graph of FIG. 1 below the illustration of drill string member 10 shows that the cross-section moment of inertia at $P_1$, where grooves 30A, 30B, 30C begin in first grooved section 18, makes a relatively smooth transition from the slip and elevator section 14 to the first grooved section 18. This graph depicts typical values for a five inch size intermediate weight member. The grooves 30A, 30B, and 30C are progressively shallower with increasing length along grooved section 18 until such grooves vanish at the lower or ungrooved section end of first grooved section 18.

As illustrated by the region $L_{22}$ of the graph of FIG. 1, the bending moment of inertia of the ungrooved section 22 is approximately fifty percent greater than that of the slip and elevator section 14.

The grooves 30A, 30B, 30C of second grooved section 20 are shallow cut at the upper or ungrooved section end and are cut progressively more deeply with increasing length as illustrated in FIGS. 1 and 2 and especially in FIGS. 5, 4 and 3. Preferably such grooves have a depth at the lower end of second grooved section 20 such that the bending moment of inertia at point $P_2$ approximately matches that of reduced diameter section 24.

The drill string member 10 of the invention may also include one or more hardbanding rings 26 and 28 about ungrooved section 22. Such rings enhance the wear characteristics of the member where the ungrooved section 22 scrapes against the borehole.

The drill string member 10 of the invention may also include one or more regions of the member which are cold worked to increase fatigue resistance at highly stressed areas. Regions $L_B$ and $L_P$ where the upper and lower tool joints 11 and 12 are joined with drill string member 10 are such high stress areas where cold working of the steel material may be beneficial.

The drill string member 10 including upper and lower tool joints 11 and 12 produces advantages of relatively flexible ends with a relatively stiff center section. The center section 22 also functions as a wear region which may be hardbanded.

An integral slip and elevator section 14 provides flexibility at one end. Varying depth grooves 30A, 30B, 30C in first grooved section 18 and second grooved section 20 allow gradual transition of flexibility or cross-section moment of inertia as a function of length over a magnitude ratio of one to about one and one-half.

One of ordinary skill in the drilling art will preferably use the drill string member 10 as an intermediate weight member between drill pipe and drill collars.

A modification of the structure of FIGS. 1 and 2 may be advantageous where hardbanding between grooved section 18 and grooved section 20 is not necessary. For such a case, the length of ungrooved section 22 may be reduced to zero such that the grooves of grooved section 18 become very shallow at its lower end and actually become continuous with the shallow grooves of grooved section 20. In other words, the shallow grooves of grooved section 18 at its lower end can be continuous with shallow grooves of grooved section 20 at its upper end.

Still another modification of the structure of FIGS. 1 and 2 may be advantageous, like that above, where the length of ungrooved section 22 may be reduced to zero. Rather than the shallow grooves of grooved section 18 being continuous with the shallow grooves of grooved section 20, such grooves may simply vanish in an alternating or interleaving manner at the point along the length of member 10 where the two grooved sections 18 and 20 come together. In other words, the two sets of groove patterns are not continuous at the intersection point, but rather are spaced from each other at sixty degree intervals, for example, about the periphery of the member 10 at the intersection of grooved section 18 and grooved section 20.

The drill string member 10 is manufactured from a steel bar or tube of outside diameter D. A bore of diameter $d_o$ is formed in the bar or tube. Slip and elevator section 14, reduced diameter section 24, and first and second grooved sections 18 and 20 are formed by conventional machining techniques. Grooves 30A, 30B and 30C are formed with a grooving machine having a flat bottomed cutter. Other groove shapes may be used by those of skill in the machining art without varying from the scope of the invention. Any grooves formed as a function of length in first and second grooved sections 18 and 20 which produce a cross-section moment of inertia versus length profile similar to that of FIG. 1 is within the scope of the invention described herein.

Various modifications and alterations in the described methods and apparatus will be apparent to those skilled in the art of the foregoing description which does not depart from the spirit of the invention. For this reason, these changes are desired to be included in the appended claims. The appended claims recite the only limitation to the present invention. The descriptive manner which is employed for setting forth the embodiments is to be interpreted as illustrative but not limitative.

What is claimed is:

1. A drill string member adapted for placement between drill collars and drill pipe comprising:
   - an integral elongate tubular member having tool joints placed at each end,
   - said integral member having a slip and elevator section of a first generally uniform outer diameter at one of its ends adjacent a tool joint,
   - said integral member having a partially grooved section of a second generally uniform outer diameter which is greater than said first outer diameter between said slip and elevator section and said other of said tool joints,
   - said partially grooved section having an ungrooved intermediate section having upper and lower ends, a first grooved end section extending from said slip and elevator section to said upper end of said ungrooved intermediate section, and a second grooved end section extending from a position adjacent said other of said tool joints to said lower end of said ungrooved intermediate section.

2. The member of claim 1 wherein said first and second grooved sections each have at least one spiral groove disposed therein.

3. The member of claim 1 wherein said first and second grooved sections each have three right hand wound spiral grooves.

4. The member of claim 1 wherein said ungrooved section includes at least one ring of hardbanding secured thereto.

5. The member of claim 1 wherein said first and second grooved sections are characterized by cross-section moments of inertia which vary as a function of their length such that
   - a cross-section moment of inertia of said first grooved section approximately matches a cross-section moment of inertia of said slip and elevator section at its upper end and approximately matches a cross-section moment of inertia of said ungrooved section at its lower end, and
   - a cross-section moment of inertia of said second grooved section approximately matches said cross-section moment of inertia of said ungrooved section at its upper end and approximately matches a cross-section moment of inertia of said slip and elevator area at its lower end.

6. The member of claim 5 wherein said first and second grooved sections each have three right hand wound spiral grooves of depth in said second outer diameter as a function of length such that said cross-section moment of inertia of said first grooved section varies approximately linearly with length from said upper end to said lower end and said cross-section moment of inertia of said second grooved section varies approximately linearly with length from said upper end to said lower end.

7. The member of claim 5 wherein said cross-section moment of inertia of said ungrooved section is approximately fifty percent greater that said cross-section moment of inertia of said slip and elevator section.

8. The member of claim 1 wherein said tool joints are welded to said tubular member at each of its ends.

9. The member of claim 1 further comprising a reduced diameter section disposed between said end of said second grooved section and said other of said tool joints, said reduced diameter section being short in length relative to the length of said second grooved section.

10. A drill string member adapted for placement between drill collars and drill pipe comprising an integral tubular member having a slip and elevator section of a first generally uniform outer diameter at its upper end, and a partially grooved section of a second generally uniform outer diameter which is greater than said first outer diameter, at a lower end of the said tubular member.

said partially grooved section having an upper grooved section extending from said slip and elevator section to an ungrooved section and a lower grooved section extending from said ungrooved section to said lower end of said tubular member, said upper grooved section characterized by a bending moment of inertia which increases approximately linearly, from a value approximately equal that of said slip and elevator section to that of said ungrooved section over the length of said first grooved section from said slip and elevator section to said ungrooved section, and said lower grooved section characterized by a bending moment of inertia which decreases approximately linearly from a value approximately equal that of said ungrooved section to that of said slip and elevator section over the length of said second grooved section from said ungrooved section to said other end of said tubular member.

11. The tool of claim 10 wherein said first and second grooved sections each have three right hand spiral grooves which vary in cross sectional area as a function of length.

12. A drill string member comprising, an integral elongate tubular member having tool joints placed at each end, said member having a slip and elevator section of a first generally uniform outer diameter at one of its ends adjacent a tool joint, said member having a grooved section of a second generally uniform outer diameter which is greater than said first outer diameter between said slip and elevator section and said other of said tool joints, said grooved section including an upper grooved section which extends downwardly from said slip and elevator section, and a lower grooved section which extends upwardly from a lower end of said tubular member, wherein said upper grooved section has grooves which are deep at its upper end and progressively become more shallow with increasing downward length of said upper grooved section and said lower grooved section has grooves which are shallow at its upper end and progressively become deeper with increasing downward length of said lower grooved section.

13. The member of claim 12 wherein said upper grooved section is characterized by a cross-section moment of inertia at its upper end which approximately matches a cross-section moment of inertia of said slip and elevator section.

14. The member of claim 13 wherein said upper grooved section is characterized by a cross-section moment of inertia at its lower end which approximately matches a cross-section moment of inertia of said lower grooved section at its upper end.

15. The member of claim 12 wherein said upper and lower grooved sections are separated by an ungrooved section.

16. The member of claim 12 wherein a lower end of said upper grooved section is contiguous with an upper end of said lower grooved section.

17. The member of claim 16 wherein said grooves of said upper grooved section at its lower end are continuous with said grooves of said lower grooved section at its upper end.

18. The member of claim 16 wherein said grooves of said upper grooved section at its lower end vanish and said grooves of said lower grooved section at its upper end vanish, and wherein said grooves of said upper and lower grooved section respectively vanish in an alternating pattern about the periphery of said member.

19. The member of claim 16 wherein said upper grooved section is characterized by a cross-section moment of inertia at its upper end which approximately matches a cross-section moment of inertia of said slip and elevator section.

20. The member of claim 19 wherein said cross-section moment of inertia of said lower end of said upper grooved section and said upper end of said lower grooved section are each approximately fifty percent greater than said cross-section moment of inertia of said slip and elevator section.

* * * * *